United States Patent [19]

Vydrin et al.

[11] 4,229,961

[45] Oct. 28, 1980

[54] CONTINUOUS MILL

[76] Inventors: Vladimir N. Vydrin, ulitsa Timiryazeva, 28-27; Valery V. Pastukhov, ulitsa Stalevarov, 28a, kv. 79; Leonid A. Barkov, ulitsa Klary Tsetkin, 30a, kv. 13; Vladimir S. Sysoev, ulitsa Artilleriiskaya, 65 B, kv. 6, all of Chelyabinsk, U.S.S.R.

[21] Appl. No.: 10,310

[22] Filed: Feb. 7, 1979

[51] Int. Cl.[3] ..... B21B 1/18; B21B 13/12

[52] U.S. Cl. ..... 72/235; 72/224

[58] Field of Search ..... 72/235, 224, 249, 237, 72/162

[56] References Cited

U.S. PATENT DOCUMENTS

| | | | |
|---|---|---|---|
| 402,140 | 4/1889 | Carr | 72/224 |
| 1,152,312 | 8/1915 | Gray | 72/235 X |
| 2,367,226 | 1/1945 | Lonsdale | 72/224 X |
| 3,016,772 | 1/1962 | Hornbostel | 72/235 X |
| 3,380,278 | 4/1968 | Dilling | 72/224 |

*Primary Examiner*—Milton S. Mehr

*Attorney, Agent, or Firm*—Fleit & Jacobson

[57] ABSTRACT

A continuous mill has a plurality of passes arranged in series and formed by work rolls which are mounted on shafts secured to common chocks accommodated in housings.

The chocks provided in the mill are equal in number to the workrolls forming a pass. Each of the chocks has two sides converging at an angle, and the shafts carrying the workrolls are cantilevered to each of said sides. The shafts secured to one side are offset relative to the shafts secured to another side so that the adjacent passes are spaced in closest possible proximity with one another; the angle between the sides of each chocks being equal to the divergence angle of the adjacent passes.

4 Claims, 6 Drawing Figures

CONTINUOUS MILL

BACKGROUND OF THE INVENTION

1. Field of the Invention

The present invention relates to rolling mills and more in particular to a continuous mill.

This invention is readily adapted to the production of rods and wire from nonferrous metals and alloys based on tungsten, molybdenum, nickel, titanium, copper, etc., Articles manufactured from these metals and alloys are finding an ever greater application in various branches of industry. However, the production of such articles on commercial scale takes up much labor and involves substantial losses in difficulty available and expensive metals and alloys. When subject to hot rolling, the above metals are easily oxidizable and the surface layers thereof are saturated with gases, which results in lower ductility of metal, leads to the formation of cracks and thus lowers the yield of the finished metal. Therefore, the metals and alloys in question are preferably worked at continuous mills provided with multiroll passes wherein it is possible to provide a desired rolling schedule. This type of rolling mill is preferably made of relatively small length.

2. Description of the Prior Art

For example, there are known rolling mills which have a plurality of four-roll passes arranged in series. The work-rolls which form the passes are mounted on shafts arranged in series and having their ends secured to common chocks fixed in housings.

In such mills the passes are spaced successively one after another so that their gaps are found in the same planes, this being the reason for nonuniform deformation of metal across its profile. In the process of rolling the metal will overflow into the spaces of the roll passes, thereby forming fins on the finished product. The fins are then removed, as a result of which the yield of the finished metal is lowered, and technological process is rendered more complicated.

There are also known continuous section mills in which the passes are mutually arranged so as to enable the direction of rolling to be alterated in each successive pass. In such mills the workrolls are provided with individual chocks. These types of mills are relatively complicated in construction, and are, therefore, difficult in maintenance and service.

Therefore, a demand has arisen for a continuous mill which will be relatively small in size, simple in construction and easy in operation, thus permitting quality of the finished product to be improved and losses in expensive metals to be reduced.

SUMMARY OF THE INVENTION

This invention provides a continuous mill having a plurality of passes arranged in series and formed by workrolls mounted on shafts secured in series to common chocks accommodated in housings, wherein, according to the invention, the chocks provided in the mill are equal in number to the workrolls forming a pass and each chock is formed with two sides converging at an angle, the shafts carrying the workrolls being cantilevered on each of said sides, with the shafts secured to one side being offset with respect to the shafts secured to another side thereby permitting the adjacent passes to be spaced in closest possible proximity with one another, and the angle between the sides of each chocks being equal to the divergence angle of the adjacent passes.

In the mill having four-roll passes the angle between the sides of each chock is preferably equal to 45 deg.

In the mill having three-roll passes the angle between the sides of each chock is preferably taken to be 60 deg.

It is also preferable that in the mill with two-roll passes the angle between the sides of each chock is 90 deg.

The construction of the chocks formed with sides converging at the specified angles ensures their maximum strength and rigidity.

The continuous mill according to the present invention enables the direction of rolling to be readily alternated in each successive pass, thus eliminating the possibility for the formation of fins, increasing the yield of the finished metal and ensuring uniform reduction of metal across the section being rolled. The mill is relatively simple in construction and is not large in length. Thus, the time period during which the hot metal is exposed to air is shortened, the losses of expensive metals due to burning and oxidation, as well as the extent to which the surface layers of metal is saturated with gases, are brought down.

BRIEF DESCRIPTION OF THE DRAWINGS

The invention will be further described, by way of example only, with reference to the accompanying drawings, in which.

DETAILED DESCRIPTION OF THE PREFERRED EMBODIMENTS

Figure 1:
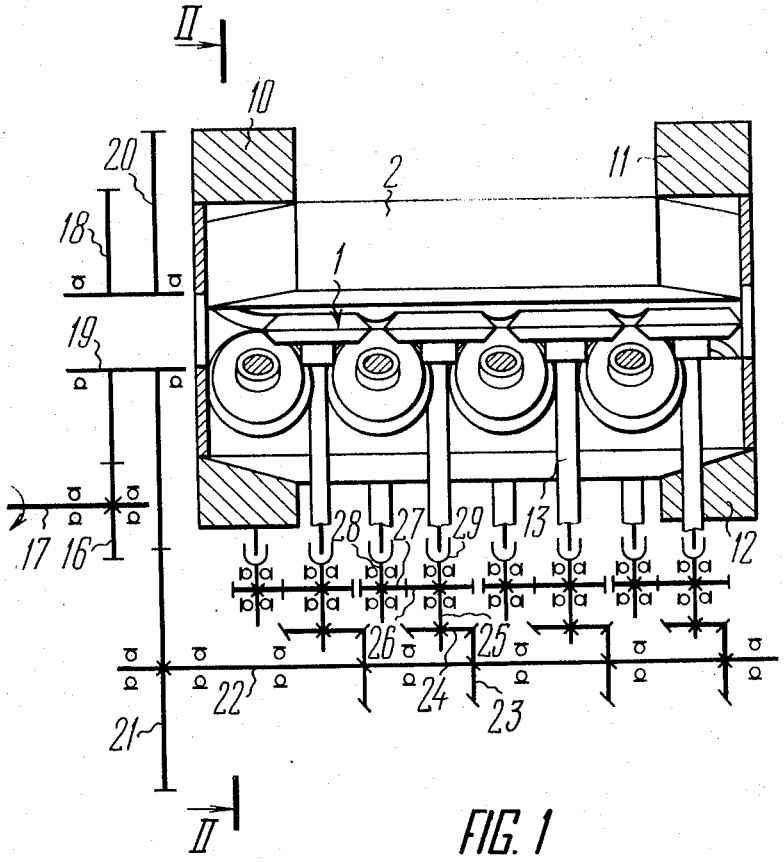
FIG. 1 is a schematic longitudinal sectional view of a continuous mill with four-roll passes.
Figure 2:
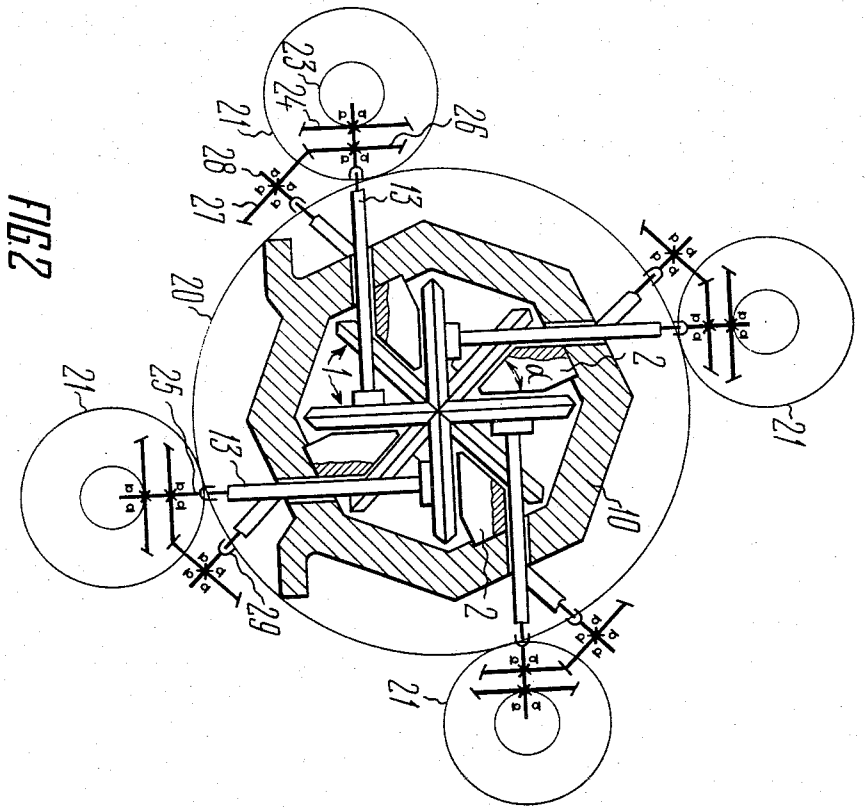
FIG. 2 is a cross section taken on the plane II—II of FIG. 1.
Figure 4:
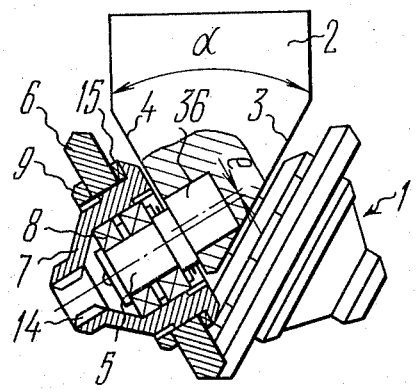
FIG. 4 is a cross section of same, taken through one of the workrolls.
Figure 3:
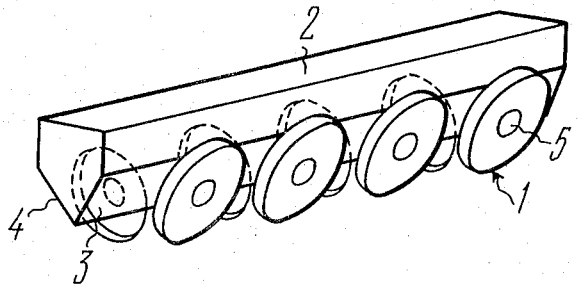
FIG. 3 is an axonometric view of a chock with workrolls mounted thereon.

The continuous mill illustrated comprises a plurality of four-roll passes arranged in series and formed by workrolls 1 (FIGS. 1,2). The continuous mill in question has eight four-roll passes. The workrolls 1 are mounted on four chocks 2, the number of which is equal to the number of the workrolls 1 forming a pass. Each chock 2 is made in the form of prism, such as shown in FIG. 3, and has two sides 3 and 4, converging at an angle $\alpha=45$ deg. Secured to each of the sides and arranged perpendicular thereto and in series are shafts 5 adapted to carry the workrolls 1. Each of the workrolls 1 incorporates a roll sleeve 6 (FIG. 4) fixed on a body 7 which accommodates bearings 8 fitted over the shafts. Axial displacement of the roll sleeve 6 relative to the body 7 is prevented by means of a screw nut 9 provided for the purpose.

A plurality of the workrolls 1 mounted on the shafts 5 secured to the sides 4 of the chocks 2 form odd-numbered passes; whereas a plurality of the workrolls 1 mounted on the shafts 5 secured to the sides 3 of the chocks 2 form even-numbered passes of the continuous mill.

The shafts 5 secured to the side 3 are spaced in closest possible proximity with the shafts 5 secured to the sides 4 so that the roll sleeves 6 of the neighbouring passes be clear of one another.

Owing to the fact that the chocks 2 are formed with two converging sides 3 and 4 whereupon are mounted the workrolls 1 forming even-numbered and odd-numbered passes, it is possible to provide for a required angular and spatial mutual disposition of the adjacent passes, thereby substantially reducing dimensions and length of the continuous mill of the invention.

The chocks 2 have their ends fixed in housings 10 (FIG. 1) and 11. To adjust the gap of the roll pass formed by the workrolls 1, the housings 10 and 11, as well as the end portions of the chocks 2, are formed with wedge-shaped surfaces 12.

Figure 5:
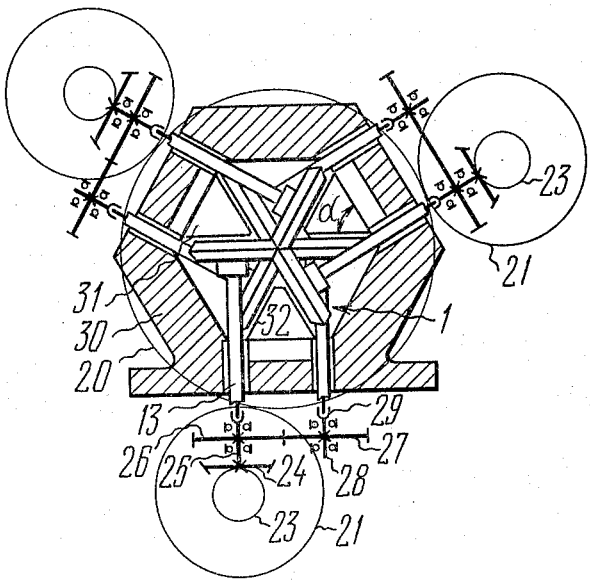
FIG. 5 is a cross sectional view of a continuous mill with three-roll passes, according to the invention.

The workrolls 1 are provided with an actuator (not shown) geared to a spindle 13 having its one end engaged with splines 14 (FIG. 4) formed in the body 7 of the workroll 1. The spindle 13 is positioned in direct proximity with the shaft 5 at the side of its free end. Torque is transmitted from the body 7 to the roll sleeve 6 through clutches 15. A gearing system comprises a pinion 16 (FIG. 1) connected with a shaft 17 of an electric motor (not shown). The pinion 16 is brought into engagement with a gear 18 fixed on a shaft 19. Rigidly mounted on the same shaft is a further gear 20 brought into engagement with four pinions 21 (FIGS. 1,2). Torque from each of the pinions 21 is given to a distributing shaft 22 having fixed thereon bevel gears 23 brought into engagement with bevel gears 24. Each bevel gear 24 is mounted on a shaft 25 having fixed thereon a pinion 26 brought into engagement with a pinion 27 rigidly mounted on a shaft 28. The shaft 25 provided for one pass and the shafts 28 provided for another are connected with their spindles 13 through couplings 29.

Where the continuous mill of the invention has three-roll passes, housings 30 (FIG. 5) mount three chocks 31 formed with sides 32 converging at an angle of 60 deg. Secured to the sides 32 are the shafts 5 adapted to carry the workrolls 1 forming three-roll passes. The adjacent passes are disposed relative to each other at an angle of 60 deg., that is at the angle equal to that formed between the sides of the chocks.

Figure 6:
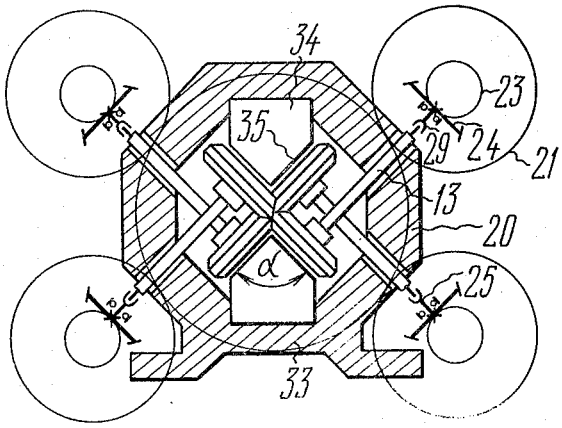
FIG. 6 is a cross sectional view of a continuous mill with two-roll passes, according to the invention.

In the event the continuous mill of the invention have two-roll passes, housings 33 (FIG. 6) mount two chocks 34 each having two sides 35 converging at an angle of 90 deg. Secured to the sides 35 are axles adapted to carry the workrolls 1 forming the two-roll passes. The adjacent passes are disposed relative to each other at an angle of 90 deg., that is at the angle equal to that formed between the sides of each chock.

The cantilevered shafts 5 (FIG. 4) are preferably fixed in the chocks 2 in a manner to enable their parallel displacement relative to their geometrical axes. This makes it possible to effect radial adjustment of each of the workrolls 1 with respect to the chock 2. To this end the shaft 5 has its end portion 36, fixed in the chock 2, formed with an eccentricity "e" in relation to the geometrical axis of the shaft 5.

The continuous mill of the invention is operated in the following manner.

Torque from an actuator (not shown) is transmitted through the shaft 17 to the pinion 16 enmeshed with the wheel 18. From the wheel 18 torque is transmitted through the shaft 19 to the wheel 20 which is driven to rotate four pinions 21. The pinions 21 are driven to transmit torque to the distributing shafts 22 which carry the bevel gears 23. From the bevel gears 23 torque is transmitted to the bevel gears 24. Transmission ratio between the bevel gears 23 and 24 in each successive pair of passes (even-numbered and odd-numbered) are established in accordance with alterations in the speed of rotation of the workrolls 1 depending on the amount of reduction of the section being rolled. From the pinions 24 torque is transmitted through the shaft 25 to the pinions 26 and 27. Transmission ratio of the pinions 26 and 27 is established in accordance with alterations in the speed of rotation of the workrolls 1 in the adjacent (even-numbered and odd-numbered) passes depending on the amount of reduction of the section being rolled. Thence, torque is transmitted through the shafts 25 and 28, as well as through the couplings 29 fixed on the ends of said shafts, to the spindles 13. The spindles 13 each has its other end brought into engagement with the splines 14 thereby transmitting torque to the body 7 of the workroll 1. The body 7 is driven to impart motion through the cams 15 to the roll sleeves 6. The roll sleeves 6 serve as working tools used for reducing the section being rolled.

The process of rolling is effected in a manner similar to that carried out as the prior-art continuous mills.

A reproduction model of the continuous mill according to the invention is being manufactured. The continuous mill, 1450 mm in length, will be provided with eight four-roll passes, each working roll being 190 mm in dia. Owing to the fact that the four-roll passes are disposed in direct proximity with one another, the section being rolled is exposed to the oxidizing atmosphere of the air but for a short period of time. As a result, losses of expensive metals are reduced and quality of the section being rolled is substantially improved.

What is claimed is:

1. A continuous multi-pass rolling mill having a plurality of work rolls per pass, with the work rolls in successive passes being mutually angularly displaced, wherein said work rolls are mounted on chocks extending lengthwise of the mill, the number of chocks being equal to the number of work rolls in each pass, each chock having a pair of opposed convergent sides extending lengthwise of the mill, said sides defining an angle therebetween equal to the displacement angle between successive work roll passes, each chock carrying one work roll for each pass of the mill and the work rolls for successive passes being arranged alternatively on said opposed sides of each chock in mutually staggered relationship lengthwise of the chock.

2. A continuous mill as claimed in claim 1, wherein each pass comprises four work rolls with the angle between said sides of each chock being 45 deg.

3. A continuous mill as claimed in claim 1, wherein each pass comprises two work rolls with the angle between said sides of each chock being 90 deg.

4. A continuous mill as claimed in claim 1, wherein each pass comprises three work rolls with the angle between said sides of each chock being 60 deg.

* * * * *